US005579817A

United States Patent [19]

Mader

[11] Patent Number: 5,579,817

[45] Date of Patent: Dec. 3, 1996

[54] WALLET PROTECTOR

[76] Inventor: Stanley C. Mader, 301 Windermere Ave., Asbury Park, N.J. 07712

[21] Appl. No.: 495,762

[22] Filed: Jun. 26, 1995

[51] Int. Cl.[6] ..... A44B 21/00; A45C 13/18; A45C 1/06

[52] U.S. Cl. ..... 150/134; 24/3.5

[58] Field of Search ..... 150/133, 134; 24/3.5

[56] References Cited

U.S. PATENT DOCUMENTS

| | | | |
|---|---|---|---|
| 982,242 | 1/1911 | Campbell | 24/3.5 |
| 1,172,482 | 2/1916 | Perkins . | |
| 1,486,472 | 3/1924 | Windecker | 150/134 X |
| 1,610,382 | 12/1926 | Jeffries | 150/134 X |
| 2,126,826 | 8/1938 | Shively | 150/134 X |
| 2,129,018 | 9/1938 | Martini, Jr. . | |
| 2,574,023 | 11/1951 | Du Pault . | |
| 2,864,144 | 12/1958 | Schick . | |
| 3,760,459 | 9/1973 | Miles . | |
| 4,194,271 | 3/1980 | Hamilton . | |
| 4,355,440 | 10/1982 | Johansson et al. . | |
| 4,891,865 | 1/1990 | Biloff . | |
| 5,031,281 | 7/1991 | Devylder . | |

*Primary Examiner*—Allan N. Shoap
*Assistant Examiner*—Niki M. Kopsidas
*Attorney, Agent, or Firm*—Nixon & Vanderhye P.C.

[57] ABSTRACT

A wallet protector, for use with a wallet, may include first and second rectangular strips of leather, the first strip having a channel and with a slide actuator extending outwardly through the channel. A slide strip, of plastic or metal, is sandwiched between the leather strips and is movable by the actuator between a first position completely within the area of the strips, to a second position extending at least an inch outwardly. The wallet protector may be stitched or otherwise attached to an end edge of a wallet body, or the wallet body itself may take the place of the second leather strip. Reinforcing stop strips of leather may be stitched to the first leather strip to provide the ends of travel of the slide actuator in the channel. The slide actuator may be substantially T-shaped and is at the first end of the slide strip, opposite a second end which is slidable outwardly from the wallet body to retard movement of the wallet body in a clothing pocket so that removal of the wallet body from the clothing pocket is readily detectable by the clothing wearer.

18 Claims, 2 Drawing Sheets

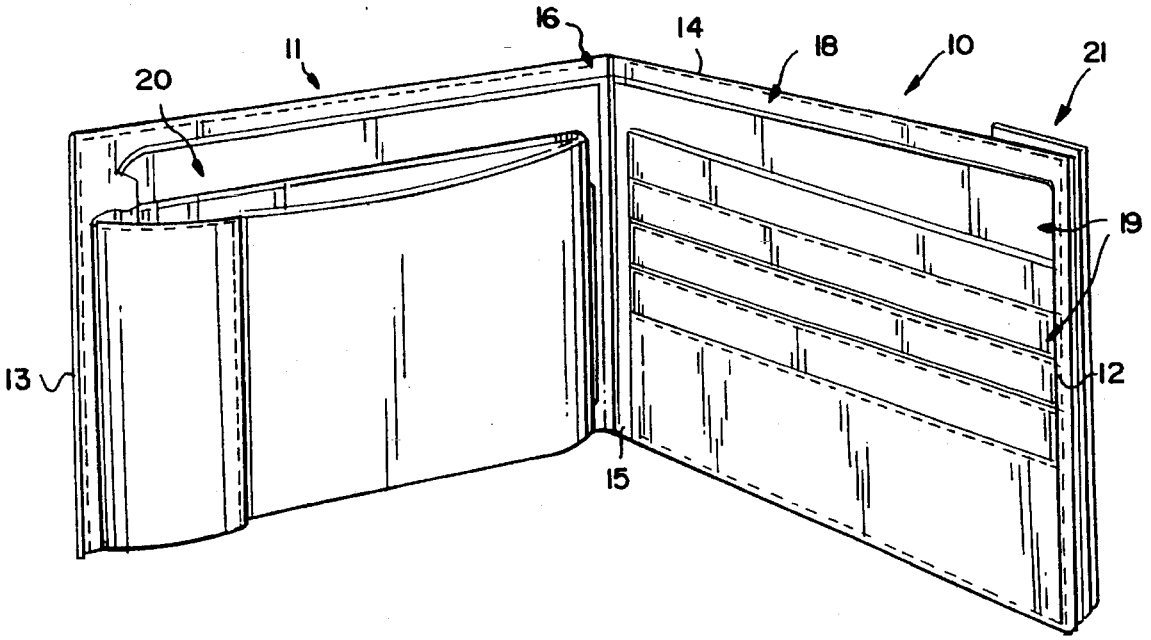
FIG. 1
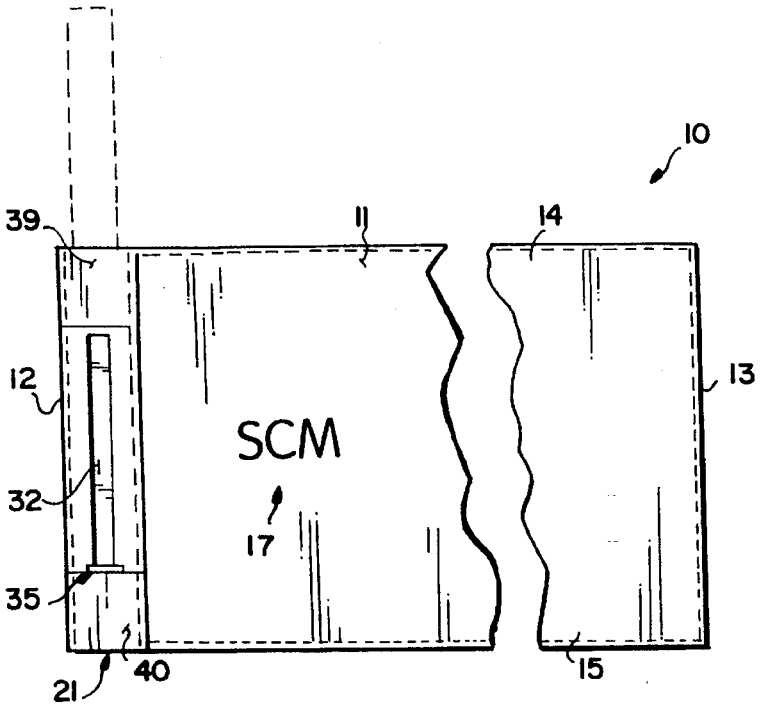
FIG. 2
FIG. 3
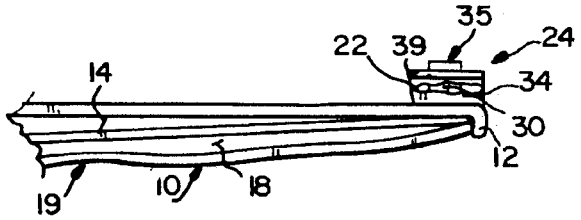

FIG. 4
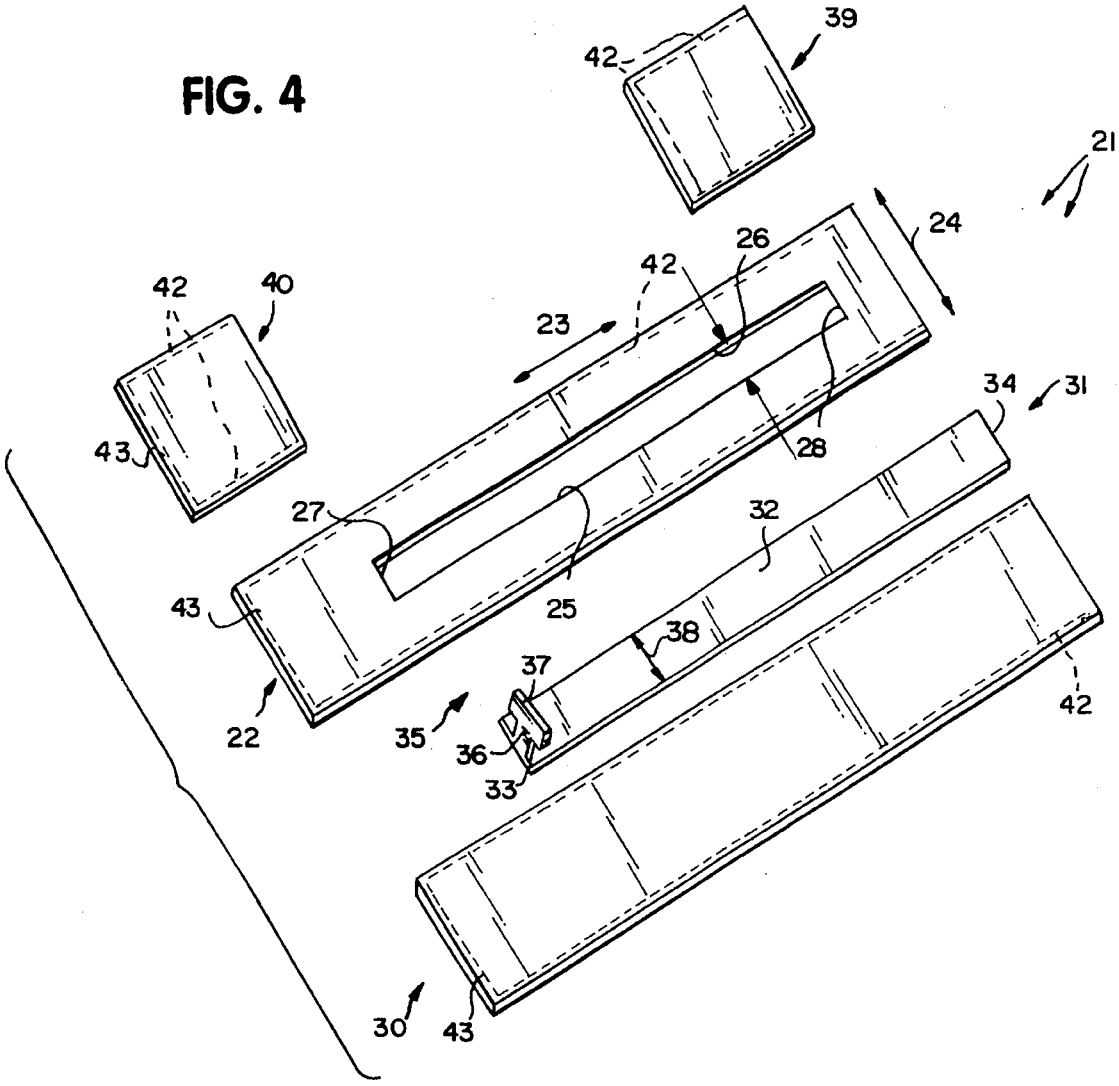
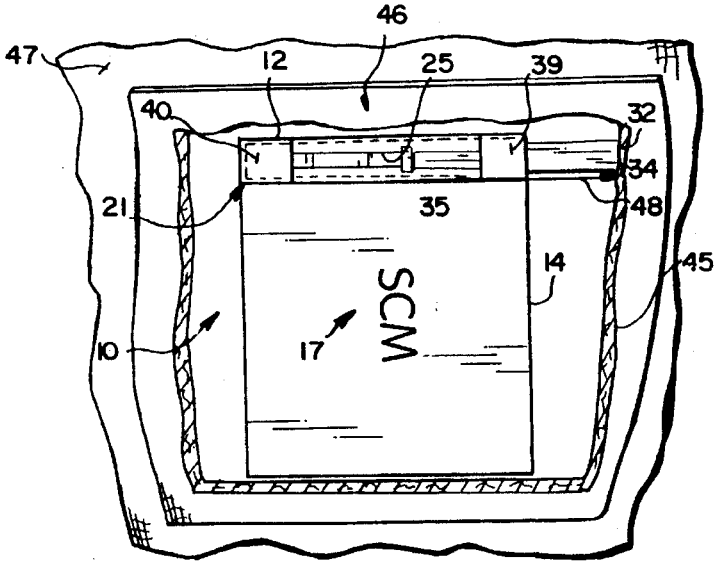
FIG. 5

WALLET PROTECTOR

BACKGROUND AND SUMMARY OF THE INVENTION

Wallets are, of course, designed to carry valuable possessions of their owners including money, credit cards, family pictures, identification cards, and the like. Therefore, it is highly desirable to retain a wallet on one's person, yet to have ready access to it, and to be able to readily utilize it. This includes the ability to be able to detect when a pick-pocket or other thief is attempting to remove one's wallet from a clothing pocket (typically a rear pants pocket), and also to be able to retain the wallet in the pocket even when on an amusement park ride or in other circumstances in which the wallet may move out of a clothing pocket.

In the past there have been numerous proposals for wallet protectors to prevent wallets from being pick-pocketed or accidentally lost, such as shown in U.S. Pat. Nos. 2,574,023, 2,864,144 and 4,355,440. While such devices are capable of functioning to prevent at least un-noticed passage of a wallet out of a clothing pocket, they have not achieved widespread acceptance, mostly because they are complex, too readily detachable from the wallet, and/or unaesthetic. Unless a wallet protector is simple, aesthetic (particularly for expensive wallets, such as leather wallets), and integral with the wallet, it is only a source of intellectual curiosity or acceptable to only a small percentage of the population.

According to the present invention, a wallet protector, and a wallet with a protector, are provided which have a number of advantages associated therewith. They are extremely simple, aesthetic (because the protector is almost un-noticeable, certainly at first glance), integral, yet effective. The protector according to the invention may be made of the same materials as the wallet with which it is preferably integral, is easy and inexpensive to construct, and elegant in use.

According to one aspect of the present invention, a wallet protector is provided which comprises the following components: A first substantially rectangular strip of leather having long and short dimensions, and a channel therein substantially parallel to the long dimension, the channel having first and second ends and a width, the width significantly less than the short dimension. A second substantially rectangular strip of leather having approximately the same shape and dimensions as the first strip, including having long and short dimensions. A slide comprising an elongated slide strip having first and second ends, and a slide actuator extending substantially transverse to the slide strip, the slide strip having a width greater than the width of the channel and less than the short dimension of the first strip of leather, and a length between the first and second ends less than the long dimension of the first strip of leather. And means for holding the first and second strips of leather together in substantially face-to-face relationship with: the slide strip sandwiched between the first and second strips; the slide actuator extending out of the channel, movable along the channel, and accessible from the exterior of the protector; and the slide strip movable between a first position substantially completely contained between the first and second strips of leather, and a second position in which the second end of the slide strip extends outwardly from the strips of leather at least about one inch.

The term "leather" as used in the present specification and claims is intended to mean natural leather or materials which are commonly known as synthetic leather, such as naugahyde and other plastics. The first and second strips of leather each have two long edges and two short edges, and the holding means preferably comprises stitching formed along both long edges and one short edge of the first and second strips of leather. However, the holding means may also comprise other structures, in addition to or in place of stitching, such as adhesive, staples, or other types of metal, plastic or fiber fasteners. The holding means preferably are permanent holding means such as described above, though they may under some circumstances comprise releasable holding means such as zippers, snaps and eyelets, buttons or the like.

The wallet protector may further comprise reinforcing stop strips of leather disposed in engagement with the opposite face of the first strip leather from the second strip of leather, and defining abutments adjacent the end of the channel. Stitching or other holding means will hold the reinforcing stop strips to at least one of the first and second leather strips.

The slide strip and slide actuator preferably comprising an integral piece of metal or plastic. The metal or plastic is preferably rigid, although in some circumstances may be flexible, and preferably has frictional integral engagement with the leather strips so as to typically stay into a position in which it has been moved with respect to the leather strips. The slide strip preferably is also lightweight; for example, it could be made of aluminum, polyethylene, polypropylene, or synthetic leather (either the same as or different than the leather making up the strips). Preferably, the slide actuator is substantially T-shaped, and is at the first end of the slide strip, having the upstanding portion of the "T" portion making frictional engagement with the channel defining walls of the first strip. In order to fit most wallets, and to be readily provided as an add-on feature to conventional wallets, the length dimension of each of the strips of leather is preferably about 3–5 inches.

According to another aspect of the present invention, a wallet with protector is provided comprising the following components: A substantially rectangular in plan wallet body including first and second substantially parallel end edges and first and second substantially parallel side edges substantially perpendicular to the end edges; the body foldable to bring the first and second end edges adjacent each other. A protector mechanism attached to the wallet body adjacent the first end edge thereof, the protector mechanism comprising a strip of material defining a channel therein substantially parallel to the first end edge; a slide comprising an elongated slide strip having first and second ends, and a slide actuator extending substantially transverse to the slide strip, the slide strip actuator dimensioned to be slidable in the channel; and means for substantially permanently holding the strip of material to the wallet body adjacent the first end edge thereof with the slide strip sandwiched between the strip of material and the wallet body; the slide actuator extending out of the channel, movable along the channel, and accessible from the exterior of the protector mechanism and wallet body; and the slide strip movable between a first position substantially completely contained within the side edges of the wallet body, and a second position in which the second end of the slide strip extends outwardly from the first side of the wallet body a distance to sufficiently retard movement of the wallet body in a clothing pocket when in the second position so that removal of the wallet body from the clothing pocket is readily detectable by the wearer of the clothing.

In the second position the second end of the slide strip typically extends from the side of the wallet body a distance of at least about an inch, e.g., between about 1–2½ inches. When the wallet body is primarily of leather, the strip of material is preferably also of leather, and typically the same type of leather. The leather strip may comprise a first leather strip and a second leather strip may also be provided, as described above with respect to the wallet protector, per se. The slide strip, slide actuator, and other components may also be as described above with respect to the wallet protector, per se.

It is a primary object of the present invention to provide a simple, aesthetic and practical wallet protector, and wallet with protector. This and other objects of the invention will become clear from an inspection of the detailed description of the invention, and from the appended claims.

BRIEF DESCRIPTION OF THE DRAWINGS

FIG. 1 is a top, inner, perspective view of an exemplary wallet with protector according to the present invention;

FIG. 2 is an outer plan view of the wallet of FIG. 1;

FIG. 3 is an end detailed view of the portion of the wallet of FIGURES 1 and 2 with an exemplary protector according to the present invention;

FIG. 4 is an exploded perspective view of an exemplary protector according to the present invention; and FIG. 5 illustrates the protector utilized with the wallet of FIGS. 1 through 3 in protecting position within a back pants pocket.

DETAILED DESCRIPTION OF THE DRAWINGS

An exemplary wallet according to the present invention is shown generally by reference numeral 10 in FIGS. 1 through 3 and 5. The wallet 10 includes a substantially rectangular in-plan wallet body 11 including first and second substantially parallel end edges 12, 13 and first and second substantially parallel side edges 14, 15, the side edges 14, 15 substantially perpendicular to the end edges 12, 13. The body 11 is of a material (such as leather, either natural or synthetic, cloth, plastic, fabric or the like) so that it is foldable, typically about an intermediate area shown generally by reference numeral 16 in FIG. 1, thereof to bring the first and second edges 12, 13 adjacent each other (e.g., substantially aligned with each other as illustrated in FIG. 5, or overlapping with some sort of fastening mechanism (such as hook and pile releasable fasteners, snaps, strips or the like). In FIGS. 2 and 5 a monogram 17 is shown on the wallet body 11 for the purposes of clearly illustrating relative orientations.

The wallet body 11 illustrated in FIGS. 1 through 3 and 5 is a conventional natural leather wallet. It includes—as seen in FIG. 1 and 3—one or more compartments 18 adjacent the side edge 14 for paper money, receipts, and the like, various flaps or pockets shown schematically at 19 in FIG. 1 for holding credit cards, ID cards, or the like, and an insert shown generally at 20 in FIG. 1 for photographs, cards, or other items.

The wallet protector according to the present invention is shown generally by reference numeral 21 in the drawings. In the preferred position illustrated in FIG. 1 through 3 and 5, the protector 21 is mounted to the outside of the wallet 10, rather than to the inside (seen in FIG. 1), although depending upon the construction of the wallet 10 or other particulars it may in some circumstances be mounted on the inside as long as the slide mechanism thereof is readily accessible). The protector 21 is preferably substantially permanently (that is not readily removable such as with snaps, hook and pile fasteners or the like, but rather, requiring significant effort including the use of tools to effect removal) to the wallet body 11 typically adjacent the edge 12 thereof. Substantially permanent fixing of the protector 21 to the body 11 may be accomplished utilizing stitching, particularly desirable for aesthetic purposes, especially where the wallet 10 is leather, although other holding means may be utilized in place of or in addition to stitching, such as suitable adhesives, staples or like substantially permanent fasteners.

In the preferred embodiment of the protector 21, the majority of the components thereof are made of leather, and protector 21 will be described with respect to leather components. However, it is to be understood that under some circumstances, such as where the wallet 10 is not leather, other materials may be utilized for the protector 21 instead of leather.

The details of the protector 21 are best seen in FIGS. 2 through 5. As seen in the preferred embodiment of FIG. 4, the protector 21 may include a first leather strip 22 which is substantially rectangular having long dimensions 23, and short dimensions 24 and with a channel 25 formed therein. The channel has a width 26, and preferably the ends 27, 28 thereof are within the strip 22 although one or both of the ends 27, 28 may be open particularly if stop and reinforcing strips (hereinafter described) are utilized.

The first strip 22 may be held (e.g., by stitching) directly on the wallet body 11, but preferably the protector 21 includes a second substantially rectangular strip 30 having approximately the same shape and dimensions as the strip 22, including long and short dimensions. The protector 21 further comprises a slide shown generally by reference numeral 31, and including an elongated slide strip 32 having a first end 33 and a second end 34, and a slide actuator 35. The width 38 of the slide 31 is preferably greater than the width 26 of the channel 25, and less than the short dimension 24 of the strip 22, and the length of the slide strip 32 (between the ends 33, 34 thereof) is less than the long dimension 23 of the strip 22. The long dimension 23 of each of the strips 22, 30 is preferably about 3–5 inches, corresponding to the conventional dimension of the end edges 12, 13 of conventional wallets 10.

The slide strip 32 may be made of a wide variety of materials. Preferably, it is of a relatively rigid material, although in some circumstances a flexible material (such as a flexible plastic) would be suitable. Typically it is made of either metal or plastic, which makes it simple to form the actuator 35 integrally with slide strip 32, which is highly desirable. The slide 31 is also preferably of a light-weight material, such as aluminum, if metal, or of a relatively light-weight plastic including types of polyethylene and polypropylene. The slide 31 may be decoratively colored and/or have decorative elements, or be of the same color as the wallet body 11 and strip 22 (e.g., if the body 11 and strip 22 are black, slide 31 may be of anodized—black—aluminum).

The integral actuator 35—as seen most clearly in FIG. 4—preferably is substantially T-shaped, including an upright portion 36 a cross portion 37. The upright portion 36 is typically narrower than the width 38 of the slide strip 32 and in fact preferably the width of the upright portion 36 is substantially the same as, or very slightly less than, the width 26 of the channel 25. The reason for this dimensioning is that the sides of the upright portion 36 can frictionally engage the walls of the strip 22 defining the channel 25, which has a tendency to hold slide 32 in a position to which it has been moved without requiring a complicated mechanical detenting or locking mechanism.

In the embodiment illustrated in the drawings, the protector 21 also comprises reinforcing stop strips of leather, shown generally by reference numerals 39 and 40, which are held by suitable holding means (stitching and/or adhesive, or other holding means as described above) to one or both of the strips 22, 30 and serving to provide the ends of travel for the slide actuator 35 in such a way that does not wear the ends 27, 28 of the channel 25.

The protector 21 illustrated in FIG. 4 may be manufactured as an integral item, and then affixed by suitable holding means, such as stitching or adhesive or metal fasteners, to the wallet body 11 as illustrated in FIGS. 2, 3 and 5. Alternatively, with or without second strip 30, and without or without the reinforcing/stop strips 39, 40, the protector 21 may be constructed integrally with the wallet body 11 and assembled while connecting it to the body 11, in fact, even using the same stitching along at least the edge 12 thereof as forms the edge of the wallet body 11.

The protector 21 is held in place as illustrated in FIGS. 2, 3 and 5 so that the slide strip 32 is sandwiched between the strips 22, 30, or between the strip 22 and the wallet body 11, with the slide actuator 35 extending out of the channel 25 and movable along the channel 25, and accessible from the exterior, as seen in FIGS. 2, 3 and 5. The slide strip 32 is movable between a first position (FIG. 1 and 2) substantially completely contained within the area of the strips 22, 30 and within the side edges 14, 15 of the wallet body 11, to a second position (FIG. 5) in which the second end 34 of slide 32 extends outwardly from the side 14 of the wallet body 11 a distance to sufficiently retard movement of the wallet body 11 in a clothing pocket 45 (a back pants pocket being illustrated in FIG. 5) so that removal of the wallet 11 through the opening 46 to the pocket 45 is readily detectable by the wearer of the pants 47—or other article of clothing—containing the pocket 45. For example, as illustrated in FIG. 5, the slot 32, second end 34 is spaced about an inch from the wallet side 14, and the total length of travel of the slide 32 exteriorly of the wallet side 14 is preferably about 2–2½ inches.

As can be seen by the phantom stitching lines 42, 43 in FIG. 4, no stitching or other holding mechanism is provided adjacent the second end 34 of the slide 32 holding the strips 22, 30 (and 39, 40 if used) together so as to allow ready passage of the second end 34 out of the area defined by the strips 22, 30. The stitching 43 may be provided adjacent the first end 33 of the slide strip 32, however, to more securely hold the protector 21 in place if necessary. Also, cross stitching, like the stitching 43, may, of course, be provided for holding strip 30 just to the strip 22, or for holding the strip 30 to the wallet body 11, but the strip 22 will not have any stitching or other holding means adjacent the channel end 28 that would restrict movement of the slide 31, second end 34 out from between the strips 22, 30.

The operation of the wallet 10 according to the present invention is extremely simple yet effective. The owner of the wallet 10 merely folds up the wallet as is conventional and inserts it in his or her pocket 45 as illustrated in FIG. 5, with the protector 21 facing away from the wearer's body, and while the wallet 10 is within the pocket 45, with his or her thumb or finger pushes on the actuator 35 to move the slide strip 32 in the direction 48 illustrated in FIG. 5, the upright portion 36 of the substantially T-shaped actuator 35 sliding in the channel 25. Sufficient frictional engagement is provided between the channel 25 walls and the actuator upright portion 36, and between the fiat upper and lower surfaces of the slide strip 32 and the cooperating strips 22, 30 sandwiched between them, that the slide strip 32 tends to stay in the position to which it has been moved without a mechanical detent or locking mechanism. With the slide strip 32 extended about an inch (or more) as illustrated in FIG. 5, if a pick pocket reaches his or hand through the pocket opening 46, and attempts to remove the wallet 10, the strip 32 will catch in the pocket 45 causing rotation or other unusual movement of the wallet 10, and thereby providing ready detection by the wearer of the pants 47. At the same time the slide 32 in the second position illustrated in FIG. 5 retards any accidental movement of the wallet 10 out of the opening 46, such as might occur on an amusement ride, or during certain physical activities, and including when the pants 47 are taken off and hung or placed in a position where the wallet 10 might otherwise fall out of the pocket 45.

When it is desirable to remove the wallet 10, all that the wearer need do is to stick his or her hand in pocket 45 through the pocket opening 46, engage the actuator 35 and move the slide strip 32 in the direction opposite the direction 48, and the wallet 10 can be removed through the pocket opening 46 as is conventional.

It will thus been seen that according to the present invention a wallet protector 21 per se has been provided which is simple, aesthetic, and inexpensive. Also, according to the present invention a wallet with protector is provided in which the protector may be readily made integral with the wallet while not significantly destroying the aesthetics or functionality of the wallet.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A wallet with a protector, comprising:

a substantially rectangular in plan wallet body including first and second substantially parallel end edges and first and second substantially parallel side edges substantially perpendicular to said end edges; said body foldable to bring said first and second end edges adjacent each other;

a protector mechanism attached to said wall body;

said protector mechanism comprising means defining a channel therein substantially parallel to said first end edge; a slide comprising an elongated slide strip having first and second ends, and a slide actuator extending substantially transverse to said slide strip, said slide strip actuator dimensioned to be slidable in said channel, said slide actuator comprising a substantially T-shaped portion including an upstanding portion actually received within said channel and a cross portion, said cross portion and upstanding portion being substantially coplanar; and said protection mechanism held to said wall body adjacent said first end edge thereof with said slide actuator extending out of said channel, movable along said channel, and accessible from the exterior of said protector mechanism and wallet body; and said slide strip movable between a first position substantially completely contained within the side edges of said wall body, and a second position in which said second end of said slide strip extends outwardly from said first side of said wallet body a distance to sufficiently retard movement of said wallet body in a clothing pocket when in said second position so that removal of said wallet body from the clothing pocket is readily detectable by the wearer of the clothing.

2. A wallet with protector as recited in claim 1 wherein said upstanding portion of said substantially T-shaped slide actuator makes frictional engagement with said means defining said channel.

3. A wallet protector in combination with a wallet and comprising:

a first substantially rectangular strip of leather having long and short dimensions, and a channel therein substantially parallel to said long dimension, said channel having first and second ends and a width, said width significantly less than said short dimension;

a second substantially rectangular strip of leather having approximately the same shape and dimensions as said first strip, including having long and short dimensions;

a slide comprising an elongated slide strip having first and second ends, and a slide actuator extending substantially transverse to said slide strip, said slide strip having a width greater than said width of said channel and less than said short dimension of said first strip of leather, and a length between said first and second ends less than said long dimension of said first strip of leather;

means for holding said first and second strips of leather together in substantially face-to-face relationship with: said slide strip sandwiched between said first and second strips; said slide actuator extending out of said channel, movable along said channel, and accessible from the exterior of said protector; and said slide strip movable between a first position substantially completely contained between said first and second strips of leather, and a second position in which said second end of said slide strip extends outwardly from said strips of leather at least about one inch; and said second strip of leather being permanently attached to said wallet.

4. A wallet protector in combination with a wallet as recited in claim 1, said first and second strips of leather each having two long edges and two short edges; and wherein said holding means comprises stitching formed along both long edges and one short edge of said first and second strips of leather.

5. A wallet protector in combination with a wallet as recited in claim 4 further comprising reinforcing stop strips of leather disposed in engagement with the opposite face of said first strip of leather from said second strip of leather and defining abutments adjacent said ends of said channel, said stitching connecting said reinforcing stop strips to at least one of said first and second strips of leather.

6. A wallet protector in combination with a wallet as recited in claim 5 wherein said slide actuator is substantially T-shaped and is at said first end of said slide strip, and has an upright portion making frictional engagement with the walls of said first strip defining said channel.

7. A wallet protector as recited in claim 4 wherein said strips of leather are natural leather.

8. A wallet protector as recited in claim 1 wherein said long dimensions of each of said strips of leather is about 3–5 inches.

9. A wallet protector in combination with a wallet as recited in claim 1 further comprising reinforcing stop strips of leather disposed in engagement with the opposite face of said first strip of leather from said second strip of leather and defining abutments adjacent said ends of said channel, said holding means holding said reinforcing stop strips to at least one of said first and second strips of leather.

10. A wallet protector in combination with a wallet as recited in claim 1 wherein said slide actuator is substantially T-shaped and is at said first end of said slide strip, and has an upright portion making frictional engagement with the walls of said first strip defining said channel.

11. A wallet protector in combination with a wallet as recited in claim 10 wherein said substantially T-shaped portion comprises an upstanding portion and a cross portion, said upright and cross portions being substantially coplanar.

12. A wallet with a protector, comprising:

a substantially rectangular in plan primarily leather wallet body including first and second substantially parallel end edges and first and second substantially parallel side edges substantially perpendicular to said end edges; said body foldable to bring said first and second end edges adjacent each other;

a protector mechanism attached to said wallet body adjacent said first end edge thereof;

said protector mechanism comprising: a first leather strip defining a channel therein substantially parallel to said first end edge; a slide comprising an elongated slide strip having first and second ends, and a slide actuator extending substantially transverse to said slide strip, said slide strip actuator dimensioned to be slidable in said channel;

means for substantially permanently holding said strip of material to said wallet body adjacent said first end edge thereof with said slide strip sandwiched between said strip of material and said wallet body; said slide actuator extending out of said channel, movable along said channel, and accessible from the exterior of said protector mechanism and wallet body; and said slide strip movable between a first position substantially completely contained within the side edges of said wallet body, and a second position in which said second end of said slide strip extends outwardly from said first side of said wallet body a distance to sufficiently retard movement of said wallet body in a clothing pocket when in said second position so that removal of said wallet body from the clothing pocket is readily detectable by the wearer of the clothing; and a second leather strip of substantially the same shape and dimensions as said first leather strip, said second leather strip sandwiched between said slide strip and said wallet body and connected to at least one of said first leather strip and said wallet body by said holding means.

13. A wallet with protector as recited in claim 12 wherein in said second position said second end of said slide strip extends outwardly from said first side of said wallet body a distance of at least about one inch.

14. A wallet with protector as recited in claim 11 wherein said holding means comprises stitching holding said first leather strip to said leather body.

15. A wallet with protector as recited in claim 11 further comprising reinforcing stop strips of leather disposed in engagement with the opposite face of said first strip of leather from said second strip of leather and defining abutments adjacent said ends of said channel, said holding means holding said reinforcing stop strips to at least one of said first and second strips of leather and said wallet body.

16. A wallet protector as recited in claim 12 wherein said slide actuator is substantially T-shaped and is at said first end of said slide strip.

17. A wallet protector as recited in claim 12 wherein said first leather strip is of natural leather.

18. A wallet protector as recited in claim 12 further comprising stop means for positively stopping the movement of said slide strip in said channel; and wherein said slide strip and slide actuator comprise an integral piece of metal or plastic, and said slide actuator is substantially T-shaped and is at said first end of said slide strip, and has an upright portion making frictional engagement with the walls of said first strip defining said channel.

* * * * *